US007914111B2

(12) United States Patent
Kulpa

(10) Patent No.: US 7,914,111 B2
(45) Date of Patent: Mar. 29, 2011

(54) PRINTER WASTE INK APPARATUS

(75) Inventor: Walter J. Kulpa, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 943 days.

(21) Appl. No.: 11/770,401

(22) Filed: Jun. 28, 2007

(65) Prior Publication Data

US 2008/0180484 A1 Jul. 31, 2008

Related U.S. Application Data

(60) Provisional application No. 60/898,552, filed on Jan. 31, 2007.

(51) Int. Cl.
*B41J 2/165* (2006.01)

(52) U.S. Cl. ..... 347/36

(58) Field of Classification Search ..... 347/36, 347/35

See application file for complete search history.

(56) References Cited

U.S. PATENT DOCUMENTS

| | | | | |
|---|---|---|---|---|
| 6,220,314 | B1 * | 4/2001 | Sato | 141/351 |
| 6,322,265 | B1 * | 11/2001 | Mindek et al. | 400/648 |
| 6,328,442 | B1 * | 12/2001 | Brinkly | 347/104 |
| 6,938,548 | B1 * | 9/2005 | Cormier et al. | 101/480 |
| 7,712,865 | B2 * | 5/2010 | Ishii et al. | 347/31 |

* cited by examiner

*Primary Examiner* — Charlie Peng
(74) *Attorney, Agent, or Firm* — George M. Macdonald; Steven Shapiro; Charles R. Malandra, Jr.

(57) ABSTRACT

Printer waste ink subsystem apparatuses are described including an apparatus located between a waste ink pump output port and a waste ink container such as a waste ink pad or sponge for containing waste ink splashing. In one illustrative example, a muffler is placed at the distal end of the waste ink pump discharge port. Such a muffler contains waste ink splatter caused by air bubbles in the waste ink stream as it exits the waste ink pump output port.

15 Claims, 3 Drawing Sheets

PRINTER WASTE INK APPARATUS

CROSS REFERENCE TO RELATED APPLICATIONS

This application claims priority under 35 U.S.C. section 119(e) from Provisional Patent Application Ser. No. 60/898,552, filed Jan. 31, 2007, entitled PRINTER WASTE INK APPARATUS, which is incorporated herein by reference in its entirety.

FIELD OF THE INVENTION

The present invention relates to a printer waste ink apparatus and more particularly in certain embodiments to apparatus for providing a muffler to feed waste ink from a waste ink pump to a waste ink storage device

BACKGROUND

Mailing machines including postage metering systems are known in the art including the DM SERIES of mailing machines available from Pitney Bowes Inc. of Stamford, Conn. A postage metering system applies evidence of postage, commonly referred to as postal indicia, to an envelope or other mail piece (directly or on a label to be applied thereto) and accounts for the value of the postage dispensed. The modern postage metering systems typically employ an inkjet printing system. Such inkjet printing systems often employ waste ink purge pumps and waste ink storage devices such as waste ink trays and waste ink sponges.

Several inkjet waste ink containment systems have an internal waste ink system been described including those in commonly owned U.S. Pat. No. 7,111,923 B2 entitled Inkjet printing system for containment and evaporation of waste ink, issued Sep. 26, 2006 to Kulpa, incorporated herein by reference.

Inkjet waste ink subsystems may suffer from ink splashing problems due to air bubbles in the waste ink stream. Accordingly, there is a need for waste ink subsystems that reduce waste ink splashing and splatter.

SUMMARY

The present application describes illustrative embodiments of a waste ink subsystem including an apparatus located between a waste ink pump output port and a waste ink container such as a waste ink pad or sponge.

In one illustrative embodiment, a muffler is placed at the distal end of the waste ink pump discharge port. Such a muffler contains waste ink splatter caused by air bubbles in the waste ink stream as it exits the waste ink pump output port.

In another illustrative embodiment, the waste ink muffler is a removable muffler having an integrated strap to facilitate attachment to the waste ink pump output port. Such a muffler provides a detachable interface with a positive attachment that may be more stable than a friction fit muffler at the output port.

In yet another illustrative embodiment, a printer system is provided with a chassis having access doors for removing a waste ink tray and/or a waste ink muffler from the waste ink subsystem for cleaning, repair, replacement or other maintenance.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

Figure 1:
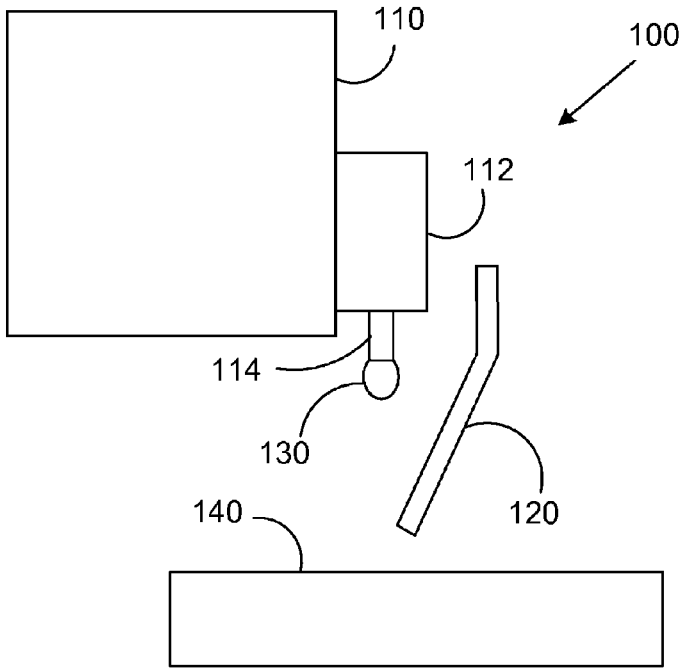
FIG. 1 is a partial schematic view of a waste ink subsystem of a mailing machine according to an illustrative embodiment of the present application.

The illustrative embodiments of the present application describe a printer waste ink apparatus and more particularly in certain embodiments to printer waste ink apparatus for providing a muffler to feed waste ink from a waste ink pump to a waste ink storage device. In one illustrative embodiment, a muffler is placed at the distal end of the waste ink pump discharge port. Such a muffler contains waste ink splatter caused by air bubbles in the waste ink stream as it exits the waste ink pump output port. In another illustrative embodiment, the waste ink muffler is a removable muffler having an integrated strap to facilitate attachment to the waste ink pump output port. Such a muffler provides a detachable interface with a positive attachment that may be more stable than a friction fit muffler at the output port.

Several conditions including maintenance operations occur when using an inkjet printing system such as a mailing machine that trigger waste ink purging processes. For example, when a new ink supply is installed in an inkjet mailing machine, a maintenance procedure is performed. A suction pump known as the waste ink pump is engaged to purge air that is trapped in the ink supply path. As ink is discharged into a waste ink container such as a waste ink tray or pad, the air bubbles present in the waste ink stream prevent the waste ink stream from being a simple and continuous ink flow. The air bubbles in the ink stream cause bubbles at the pump discharge port. Some bubbles expand and burst at the discharge port. The bursting bubbles splatter waste ink over a broad area of the waste ink tray or pad. This ink splatter occurs in all directions including upwards toward the pump itself causing ink fouling inside the inkjet printer or mailing machine. Furthermore, the internal surfaces of the printing device in the area near the waste ink subsystem may contain sharp edges that further facilitate bursting of the bubbles, particularly if the bubbles expand far from the diameter of the waste ink purge pump outlet port.

Among other advantages, the waste ink apparatuses described in the illustrative embodiments herein provide a mechanism and location for the waste ink bubbles to burst in a controlled environment so that waste ink does not splash in a wider area of the printer device. The apparatus also provide a location for waste ink bubbles to dissipate their internal pressure before exiting to the waste ink storage area.

In certain inkjet printing devices, the waste ink pump output port is inserted into a covered waste ink tray. In such a system, the waste ink tray removal process is not a simple customer process, but an involved maintenance service process involving opening the printer or mailing machine. Such as system is not useful in a printing machine or mailing machine requiring a relatively easily removed waste ink tray and/or pad. For example, if the waste ink pump output port fed into a covered waste ink tray, it would not be possible to laterally slide out the tray since the waste ink pump port would interfere with that motion.

Accordingly, another advantage of the waste ink apparatuses described in the illustrative embodiments herein provide a mechanism that may be relatively easily removed for maintenance such as by laterally sliding the waste ink tray from the printer.

Referring to FIG. 1, a partial schematic view of a waste ink subsystem 100 of a mailing machine according to an illustrative embodiment of the present application is shown. An ink system 110 includes a waste ink purge pump 112 having a waste ink pump output port 114 that discharges waste ink 130 at the distal end of the port. The waste ink 130 may include air bubbles. A bursting bubble splash guard 120 may be used to burst the waste ink bubbles before they enter the waste ink pad 140.

Figure 2:
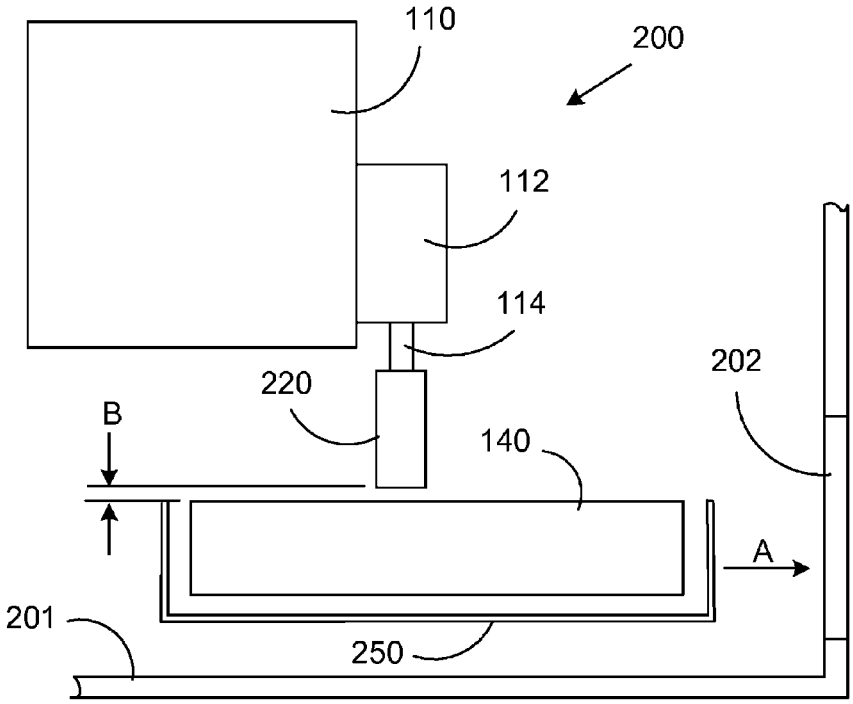
FIG. 2 is a partial schematic view of a waste ink subsystem of a mailing machine according to another illustrative embodiment of the present application.

Referring to FIG. 2, a partial schematic view of a waste ink subsystem 200 of a mailing machine according to another illustrative embodiment of the present application is shown. The ink system 110 includes an ink purge pump 112 having an output port 114. At the distal end of the output port 114, a splash preventing muffler 220 is attached. In this embodiment, the splash preventing muffler 220 is a cylindrical tube with an inside diameter relatively large compared to the inside diameter of the output port 114. The large inside diameter of the muffler 220 allows the ink bubbles to burst or depressurize but only allows the ink to exit in the direction of the waste ink pad. Here the muffler 220 molded plastic that is attached to the output port 114 using a friction fit, but could alternatively be molded with and integral to the output port. In another alternative, other shapes may be used in constructing the tube. As shown below, alternative materials such as rubber or other elastic material may be utilized in constructing the muffler 220.

The printing system or mailing machine includes a chassis 201. The chassis includes a waste tray exit port 202 that allows for removal of the waste ink tray 250 and cleaning or replacement of the waste ink pad 140. As the waste ink tray 250 is removed to the chassis port 202 in direction A, the bottom distal portion of the muffler 220 maintains a clearance B from the waste ink tray 250 and waste ink pad 140 so that the tray can be removed. The chassis 201 and tray 250 may be a suitable material such as plastic or metal and the waste ink tray 250 may include a guide groove for mating with the chassis 201 to facilitate removal and insertion of the waste ink tray 250 through chassis port 202.

Figure 3:
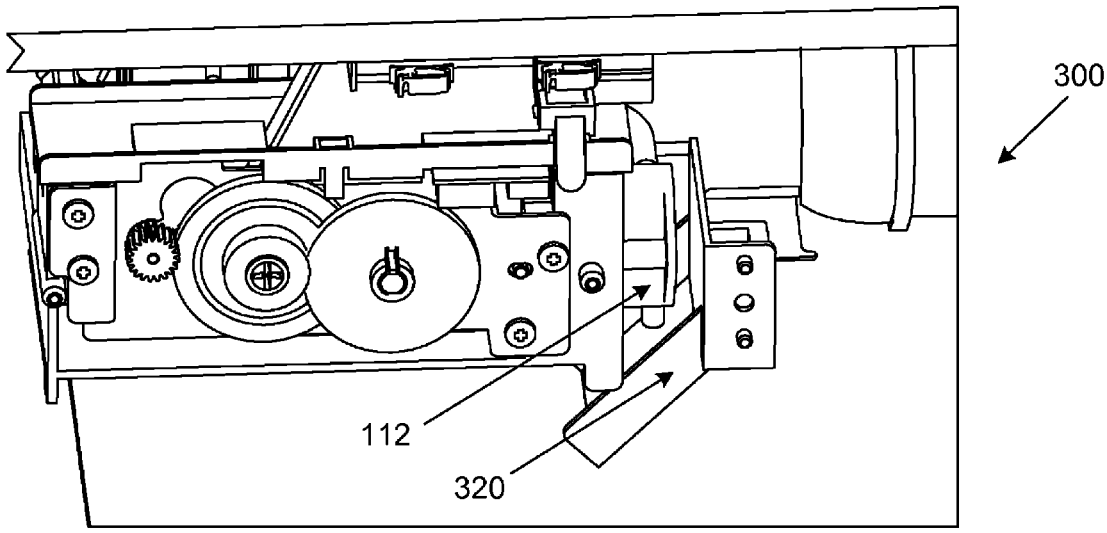
FIG. 3 is a perspective view of a waste ink subsystem of a mailing machine according to another illustrative embodiment of the present application.

Referring to FIG. 3, a perspective view of a waste ink subsystem 300 of a mailing machine according to another illustrative embodiment of the present application is shown. The splash baffler 320 allows bursting bubbles to splash in the directions that are not baffled.

Figure 4:
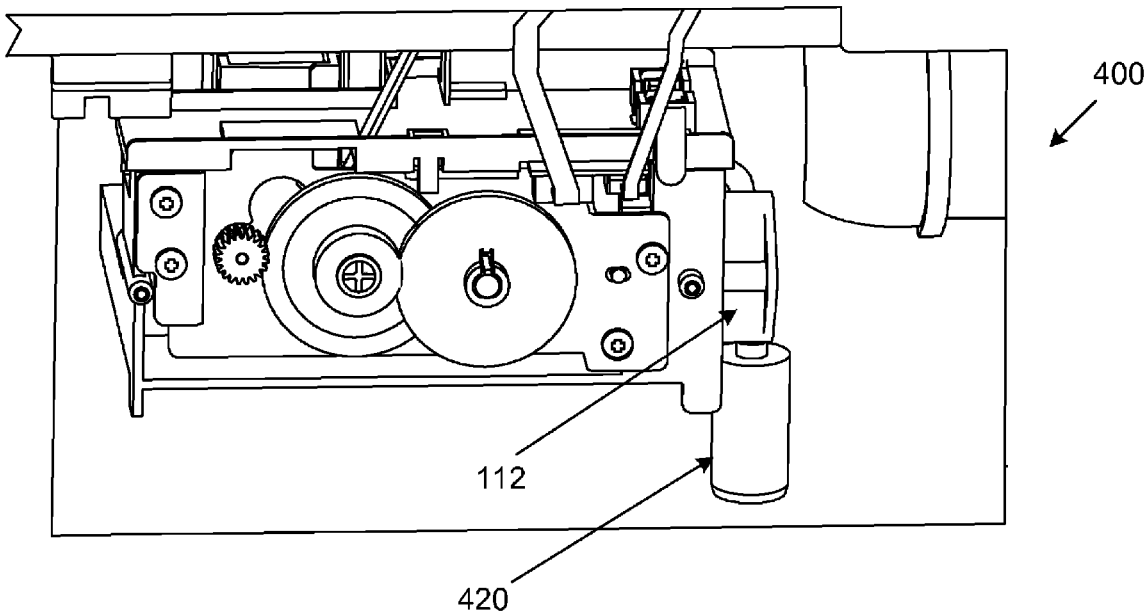
FIG. 4 is a perspective view of a waste ink subsystem including a muffler of a mailing machine according to another illustrative embodiment of the present application.

Referring to FIG. 4, a perspective view of a waste ink subsystem 400 including a muffler of a mailing machine according to another illustrative embodiment of the present application is shown. The muffler 420 is friction fit to the output of the purge pump 112 and allows ink bubbles to burst within it and only allows ink to drop vertically out of the bottom.

Figure 5:
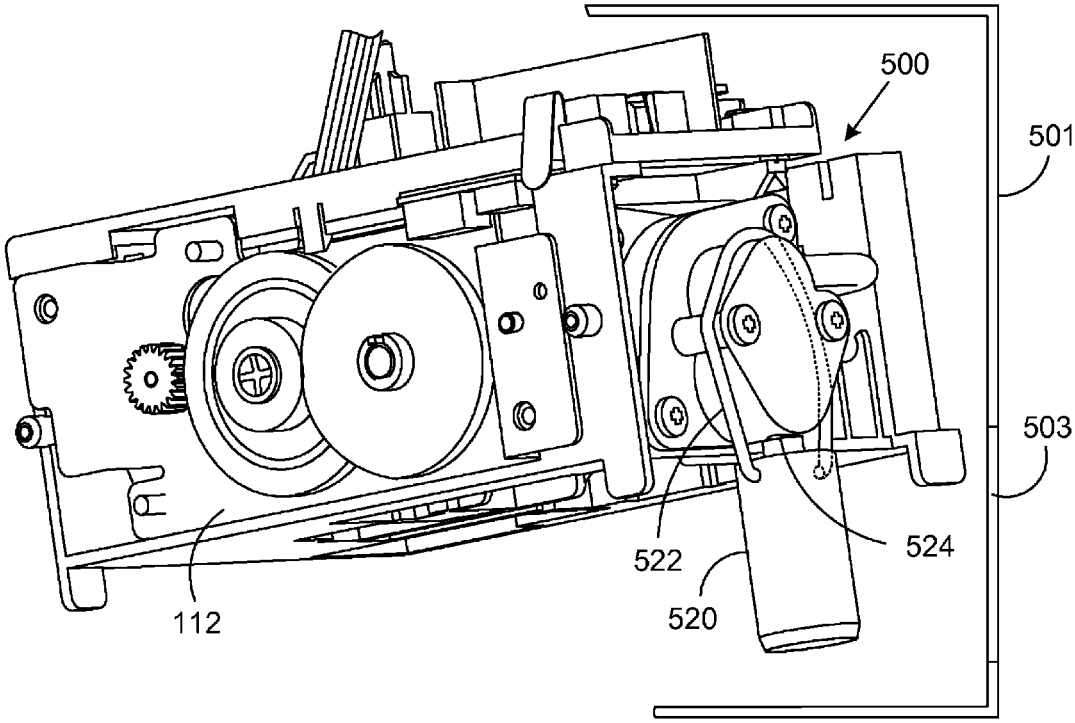
FIG. 5 is a perspective view of a waste ink subsystem including a removable muffler with integral strap of a mailing machine according to another illustrative embodiment of the present application.

Referring to FIG. 5, a perspective view of a waste ink subsystem 500 including a removable muffler with integral strap of a mailing machine according to another illustrative embodiment of the present application is shown. The purge pump 112 is connected to muffler 520 using an integral strap 522 that holds the muffler in place instead of relying on a simple friction fit at the purge pump output port at connection location 524. The integral strap 522 is made of rubber or alternatively an appropriate elastic material. The mailing machine waste ink subsystem 500 includes a waste ink tray, waste ink pad and chassis waste ink tray output port including a door as shown in FIG. 2.

In this embodiment, the chassis of the mailing machine 501 includes a muffler cleaning port 503 including a door. Since the muffler 520 is removably attached to the output port of the purge pump using the integral strap 522, the user may open the muffler chassis port 503 to remove the muffler for cleaning.

Figure 6:
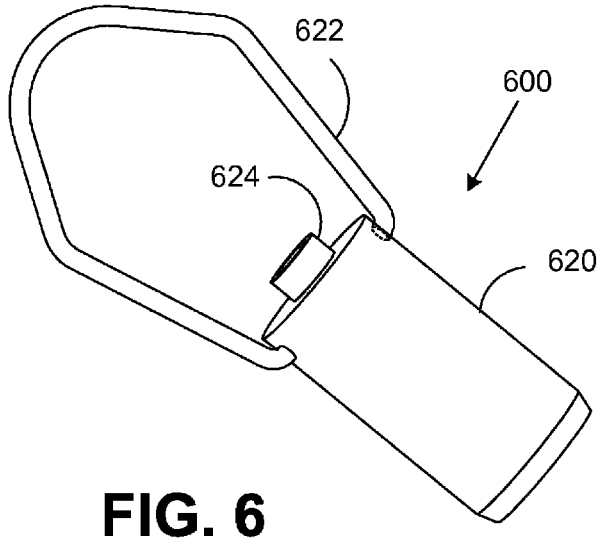
FIG. 6 is a perspective view of a waste ink subsystem muffler with integral strap of a mailing machine according to another illustrative embodiment of the present application.

Referring to FIG. 6, a perspective view of a waste ink subsystem muffler 600 with integral strap of a mailing machine according to another illustrative embodiment of the present application. The muffler includes a main body 620 including a muffler input port 624 for mating to the purge pump output port and an integral strap 622 for attaching the muffler to the purge pump. The body of the muffler includes an input diameter that is relatively large compared to the input diameter of the purge pump output port. For example, the inside diameter of the muffler is three times the inside diameter of the purge pump output port. In an alternative, the strap is not integral, but rather attached to the muffler. Since the strap 622 is used to secure the muffler, the muffler input port 624 may be slightly larger than the purge pump output port to contain the ink but not be friction fit.

While several embodiments of the invention have been described and illustrated above, it should be understood that these are exemplary of the invention and are not to be considered as limiting. Additions, deletions, substitutions, and other modifications can be made without departing from the spirit or scope of the present invention. In addition, the concepts of the present invention are not limited to application in the area of postal indicia printing, but may also be used in connection with other devices benefiting from better contrast. Accordingly, the invention is not to be considered as limited by the foregoing description.

I claim:

1. A printer waste ink system comprising:

a purge pump having an output port for purging ink; and a muffler attached at a top end of the muffler to the distal end of the purge pump output port and having a bottom end for discharge of waste ink, wherein:

the muffler comprises a cylindrical tube having an inside diameter larger than an inside diameter of the output port, and the muffler comprises a body and a strap for attaching the muffler to the purge pump.

2. The system of claim 1 further comprising:

a waste ink tray having a clearance from the bottom end of the muffler.

3. The system of claim 1 wherein:

the strap is integral to the muffler.

4. The system of claim 3 wherein:

the muffler comprises an input port that surrounds the purge pump output port but that is not friction fit.

5. The system of claim 1, wherein:
the body comprises a rubber body.
6. A printer having a chassis comprising:
a waste ink system including,
a purge pump having an output port for purging ink;
a muffler attached at a top end of the muffler to the distal end of the purge pump output port and having a bottom end for discharge of waste ink, and
a waste ink tray for storing the waste ink; and
a chassis port in the chassis for removing the waste ink tray, wherein the muffler is maintained at a clearance from the waste ink tray so that the waste ink tray may be removed through the chassis port without contacting the muffler, wherein:
the muffler comprises a cylindrical tube having an inside diameter larger than an inside diameter of the output port, and
the muffler comprises a body and a strap for attaching the muffler to the purge pump.
7. The system of claim 6 further comprising:
a waste ink tray door securing the chassis port.
8. The system of claim 6 wherein:
the strap is integral to the muffler.
9. The system of claim 6 wherein:
the muffler comprises an input port that surrounds the purge pump output port but that is not friction fit.
10. The system of claim 6 further comprising:
a second chassis port in the chassis for removing the muffler.
11. The system of claim 10 further comprising:
a muffler door securing the second chassis port.
12. The system of claim 6, wherein:
the body comprises a rubber body.
13. A printer having a chassis comprising:
a waste ink system including,
a purge pump having an output port for purging ink; and
a muffler attached at a top end of the muffler to the distal end of the purge pump output port and having a bottom end for discharge of waste ink;
a muffler chassis port in the chassis for removing the muffler
a waste ink tray for storing the waste ink; and
a waste ink tray chassis port in the chassis for removing the waste ink tray,
wherein,
the muffler is maintained at a clearance from the waste ink tray so that the waste ink tray may be removed through the chassis port without contacting the muffler
the muffler comprises a body and an integral strap for attaching the muffler to the purge pump; and
the muffler comprises an input port that surrounds the purge pump output port but that is not friction fit.
14. The system of claim 13 wherein:
the muffler comprises a cylindrical tube having an inside diameter larger than an inside diameter of the output port.
15. The system of claim 13, wherein:
the body comprises a rubber body.

* * * * *